US007934596B1

(12) United States Patent
Aycock

(10) Patent No.: US 7,934,596 B1
(45) Date of Patent: May 3, 2011

(54) COLLAPSIBLE ORGANIZATION AND WORKSTATION SYSTEM

(75) Inventor: Michael Aycock, Colleyville, TX (US)

(73) Assignee: Eureka Sales & Marketing, Inc., Colleyville, TX (US)

( * ) Notice: Subject to any disclaimer, the term of this patent is extended or adjusted under 35 U.S.C. 154(b) by 52 days.

(21) Appl. No.: 12/431,395

(22) Filed: Apr. 28, 2009

(51) Int. Cl.
*B65D 5/52* (2006.01)

(52) U.S. Cl. ..... 206/45.24; 206/575; 248/447; 248/460

(58) Field of Classification Search ..... 248/447, 248/448, 460, 462; 206/45.2, 45.24, 575, 206/225
See application file for complete search history.

(56) References Cited

U.S. PATENT DOCUMENTS

| | | | | | |
|---|---|---|---|---|---|
| 2,080,119 | A | * | 5/1937 | Duell | 211/49.1 |
| 3,164,256 | A | * | 1/1965 | Bennett | 211/70.5 |
| 3,467,259 | A | * | 9/1969 | Silver | 211/74 |
| 4,651,872 | A | * | 3/1987 | Joyce | 206/760 |
| D314,087 | S | | 1/1991 | Macklin | |
| 5,104,085 | A | * | 4/1992 | Brice | 248/441.1 |
| D355,085 | S | | 2/1995 | Wilhite et al. | |
| 5,413,305 | A | * | 5/1995 | Leeb | 248/460 |
| D361,225 | S | | 8/1995 | Wilhite et al. | |
| 5,713,552 | A | * | 2/1998 | Diamant | 248/460 |
| 5,720,464 | A | * | 2/1998 | Meinscher et al. | 248/447 |
| 5,855,351 | A | * | 1/1999 | Cziraky et al. | 248/451 |
| 6,006,502 | A | | 12/1999 | Smith | |
| 6,123,197 | A | | 9/2000 | Marquez et al. | |
| 7,134,548 | B2 | * | 11/2006 | Meehan et al. | 206/315.1 |
| 7,134,583 | B2 | | 11/2006 | May et al. | |
| 7,299,928 | B2 | * | 11/2007 | Bennett | 206/762 |
| 7,424,843 | B2 | | 9/2008 | Guillory | |
| 2001/0040111 | A1 | | 11/2001 | Spradlin et al. | |
| 2005/0127083 | A1 | | 6/2005 | Russell | |
| 2005/0274631 | A1 | * | 12/2005 | Martin | 206/1.7 |
| 2006/0021485 | A1 | | 2/2006 | Richards | |
| 2006/0037873 | A1 | | 2/2006 | Elgart | |
| 2007/0152011 | A1 | | 7/2007 | May | |
| 2008/0093524 | A1 | * | 4/2008 | Bertrand | 248/460 |
| 2008/0098868 | A1 | | 5/2008 | Guillory | |
| 2008/0245699 | A1 | | 10/2008 | Salazar | |

OTHER PUBLICATIONS

Identification of some related products, 14 pages.

* cited by examiner

*Primary Examiner* — Terrell McKinnon
*Assistant Examiner* — Bradley H Duckworth
(74) *Attorney, Agent, or Firm* — Haynes and Boone LLP

(57) ABSTRACT

A storage and organization system for storing wrapping paper rolls and wrapping supplies includes a first supply holding side and a second supply holding side pivotally connected to each other between a workstation orientation and a storage orientation. The workstation orientation is an orientation where the first and second supply holding sides form an angle and the storage orientation is an orientation where the first and second sides are substantially parallel. The first and second supply holding sides each have an inwardly facing surface facing the opposing supply holding side and an outwardly facing surface facing away from the opposing supply holding side. A plurality of wrapping paper roll-receiving features and a plurality of supply receiving features are disposed on the outwardly facing surfaces of the respective first and second supply holding sides.

31 Claims, 13 Drawing Sheets

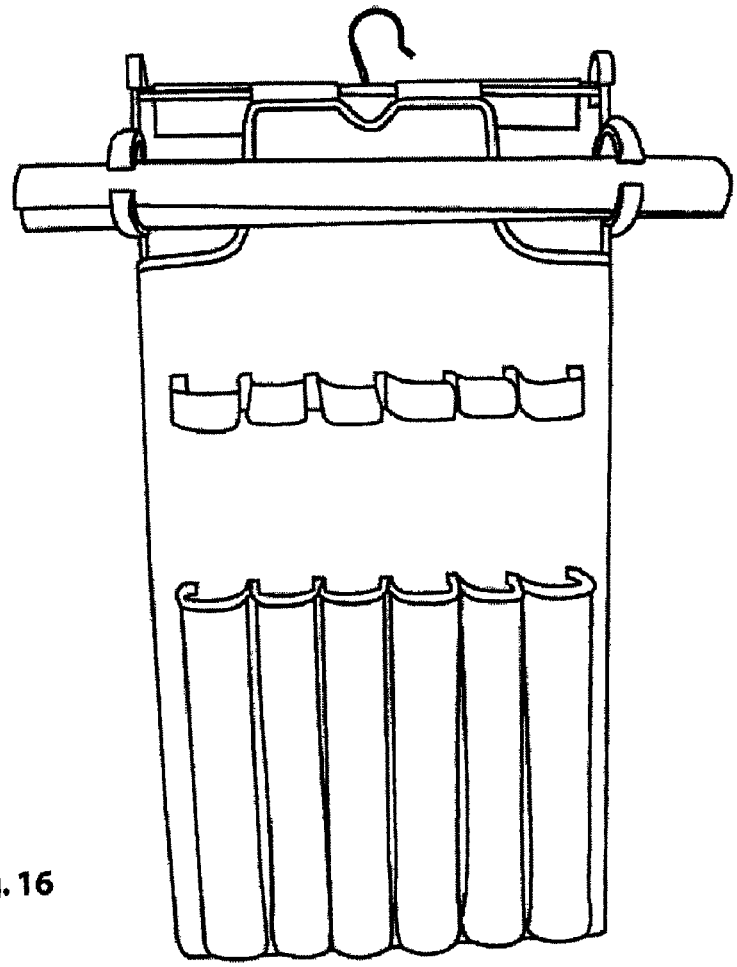
Fig. 16
Fig. 17
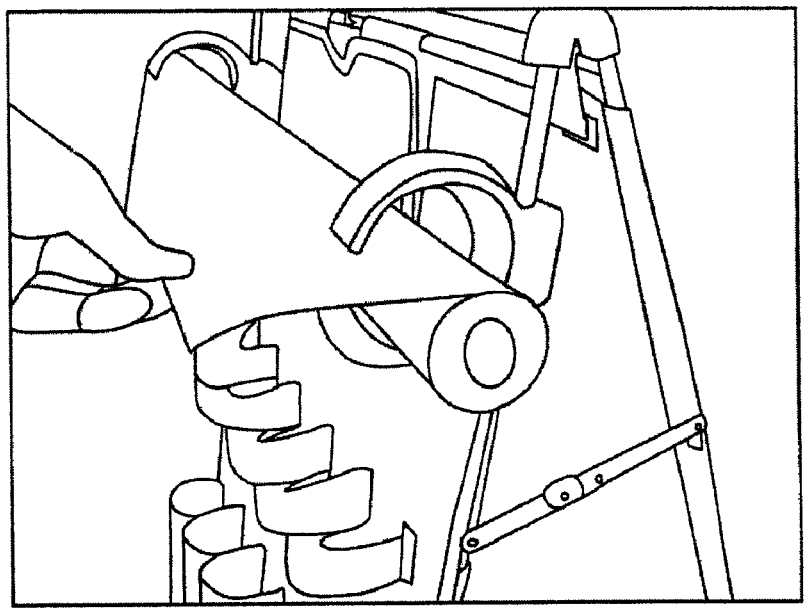

COLLAPSIBLE ORGANIZATION AND WORKSTATION SYSTEM

TECHNICAL FIELD

This disclosure relates in general to a system for organizing; and more particularly, this disclosure relates to a collapsible system of organizing and storing supplies.

BACKGROUND

Gift wrapping supplies frequently clutter closets, attics, and storage spaces. These items are frequently stored in bags or boxes, without a high level organization. Such storage techniques often result in wrinkled and torn wrapping paper even on the rolls. Further, rolls of gift wrapping paper stored in bags or boxes are sometimes stored separate from other gift wrapping supplies. Accordingly, gathering gift wrapping supplies for a wrapping project can become time consuming.

The present disclosure overcomes one or more shortcomings in the art.

SUMMARY

In one exemplary aspect, the present disclosure is directed to a storage and organization system for storing wrapping paper rolls and wrapping supplies. The system includes a first supply holding side having a plurality of wrapping paper roll-receiving features, each sized to receive at least a portion of a wrapping paper roll. It also includes a second supply holding side having a plurality of supply receiving features sized to receive wrapping supplies. The first and second supply holding sides are pivotally connected to each other and are pivotable between a workstation orientation and a storage orientation. The workstation orientation is an orientation where the first and second supply holding sides form an angle and the storage orientation is an orientation where the first and second sides are substantially parallel. The first and second supply holding sides each have an inwardly facing surface facing the opposing supply holding side and an outwardly facing surface facing away from the opposing supply holding side. The plurality of wrapping paper roll-receiving features and the plurality of supply receiving features are disposed on the outwardly facing surfaces of the respective first and second supply holding sides.

In another exemplary aspect, the present disclosure is directed to a storage and organization system for supplies. The system includes a collapsible A-frame portion providing structural support to the system. The frame portion has first and second substantially planar sides pivotable about an apex between a first workstation orientation and a second storage orientation. The first workstation orientation is an orientation where the first and second sides form an angle and the second storage orientation is an orientation where the first and second sides are substantially parallel. The system also includes a flexible first supply holding portion secured onto the first substantially planar side of the frame and includes a flexible second supply holding portion secured onto the second substantially planar side of the frame. The first and second supply holding portions each have an inwardly facing side facing the opposing supply holding portion and an outwardly facing surface facing away from the opposing supply holding portion. The first and second supply receiving features are disposed on the outwardly facing surface of the respective first and second supply holding portions.

In another exemplary aspect, the present disclosure is directed to a storage and organization system for supplies. The system includes a rigid frame portion providing structural support to the system. The frame portion has first and second substantially planar sides pivotable about an apex between a first workstation orientation and a second storage orientation. The first workstation orientation is a orientation where the first and second sides form an angle and the second storage orientation is a orientation where the first and second sides are substantially parallel. Each of the first and second substantially planar sides includes an uppermost support and a lowermost support. A hanger connects to and extends from the uppermost support of the frame. A connecting mechanism extends between the first and second substantially planar sides and is configured to limit the pivot range of the first and second substantially planar sides. The system also includes a flexible first supply holding portion secured onto the first substantially planar side of the frame. The first supply holding portion including first supply receiving features thereon. The system also includes a flexible second supply holding portion secured onto the second substantially planar side of the frame. The second supply holding portion including second supply receiving features thereon. The first and second supply holding portions each having an inwardly facing surface facing the opposing supply holding portion and an outwardly facing surface facing away from the opposing supply holding portion. The first and second supply receiving features are disposed on the outwardly facing surface of the respective first and second supply holding portions.

In another exemplary embodiment this disclosure is directed to a method of using a gift wrapping supply organization system having at least two outwardly facing sides. The method comprises the steps of inserting at least one roll of gift wrapping paper into a supply feature on one of the outwardly facing sides of the organization system and inserting at least one other gift wrapping supply into a supply feature on one of the outwardly facing sides of the orientation system. The method also includes expanding the system from a storage orientation where the outwardly facing sides are substantially parallel to a workstation orientation where the system is free-standing. The user many then remove, use, and replace at least a portion of the roll of gift wrapping paper. The method includes collapsing the system from the free-standing workstation orientation to the substantially parallel storage orientation and hanging the system for storage.

In another exemplary embodiment this disclosure is directed to a storage and organization system for supplies. It includes a collapsible A-frame portion providing structural support to the system. The frame portion has first and second substantially planar sides pivotable about an apex in a range of about 60 degrees or less between a first workstation orientation and a second storage orientation. The first workstation orientation is an orientation where the first and second sides form an angle and the second storage orientation is an orientation where the first and second sides are substantially parallel. Each of the first and second substantially planar sides have an inwardly facing surface facing the opposing substantially planar side and an outwardly facing surface facing away from the opposing substantially planar side. The system includes first supply holding portions disposed on the outwardly facing surface of the first substantially planar side of the frame portion and includes second supply holding portions disposed on the outwardly facing surface of the second substantially planar side of the frame portion such that supplies may be disposed on the outwardly facing surfaces of both the first and second substantially planar sides of the A-frame portion.

Further aspects, forms, embodiments, objects, features, benefits, and advantages of the present invention shall become apparent from the detailed drawings and descriptions provided herein.

BRIEF DESCRIPTION OF THE DRAWINGS

FIGS. 16 and 17 are illustrations showing the exemplary storage device of FIG. 10 with a paper roll in the wrapping paper dispenser.

DETAILED DESCRIPTION

Figure 1:
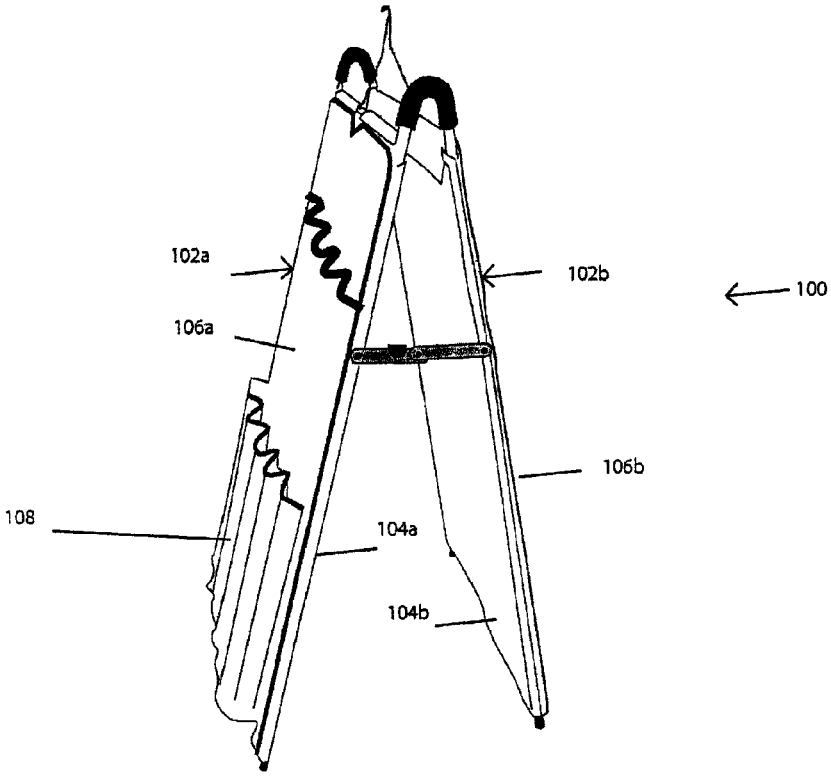
FIG. 1 is an illustration of an exemplary storage device according to a first embodiment of the present disclosure in a workstation orientation.

For the purposes of promoting an understanding of the principles of the invention, reference will now be made to the embodiments, or examples, illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

The present disclosure is directed to an organization and storage system that neatly secures in place a number of rolls, tools, and/or supplies for accomplishing a particular task. In the exemplary embodiments shown herein, the organization and storage system is particularly adapted for the storage and organization of gift wrapping paper and related gift-wrapping supplies. Here, rolls of gift wrapping paper are neatly secured at a first portion of the device, while supplies, such as, but not limited to, scissors, ribbons, bags, gift tags, pens, markers, and tape, for example, are secured at a second portion on the device formed of, for example, band connectors, pockets, sleeves, and/or other holders and receptacles.

The system disclosed herein is advantageous over known system because in addition to the organization advantages mentioned herein, it collapses or transforms from a storage orientation having a smaller footprint to a stand-alone workstation orientation having a larger footprint providing simple user access to the materials held therein. The system not only provides for logical and organized storage of all supplies, but positions all required supplies in one area so that all items needed for the project are instantly accessible for ease of use, at less than an arm's length away. Additional details and advantages will become apparent from the description of exemplary embodiments below.

Figure 2:
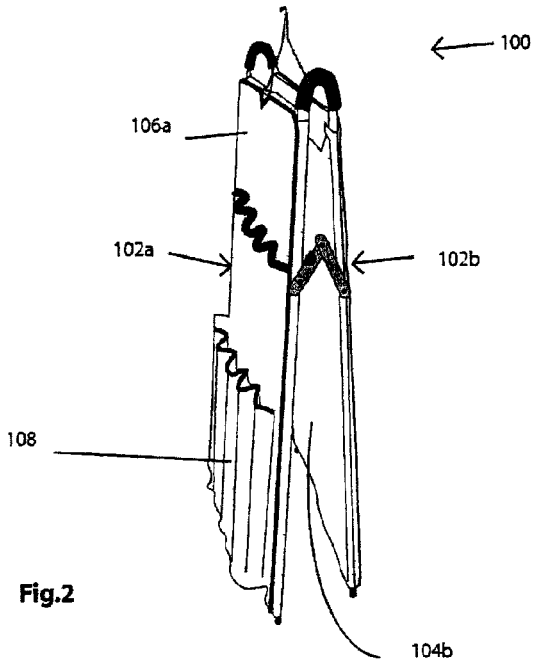
FIG. 2 is an illustration of the storage device in a storage orientation.

FIGS. 1 and 2 show a first embodiment of an organization system, referenced herein by the numeral 100. The organization system 100 comprises a first expanded or workstation orientation as shown in FIG. 1, and a collapsed storage orientation shown in FIG. 2. Therefore, the system may be expanded as a stand-alone system providing simple, easy access to any stored supplies, and may be transformed to a storage orientation smaller than the expanded orientation.

The system 100 includes first and second supply holding sides 102*a*, 102*b*. Each of these supply holding sides include an inwardly facing surface 104*a*, 104*b* and an outwardly facing surface 106*a*, 106*b*. The inwardly facing surfaces each face the opposing supply holding side, while the outwardly facing surfaces face outwardly from the system 100. As shown generally in FIGS. 1 and 2, the system 100 includes supply receiving features 108 on the outwardly facing surfaces 106 in both the workstation orientation and the storage orientation.

Figure 3:
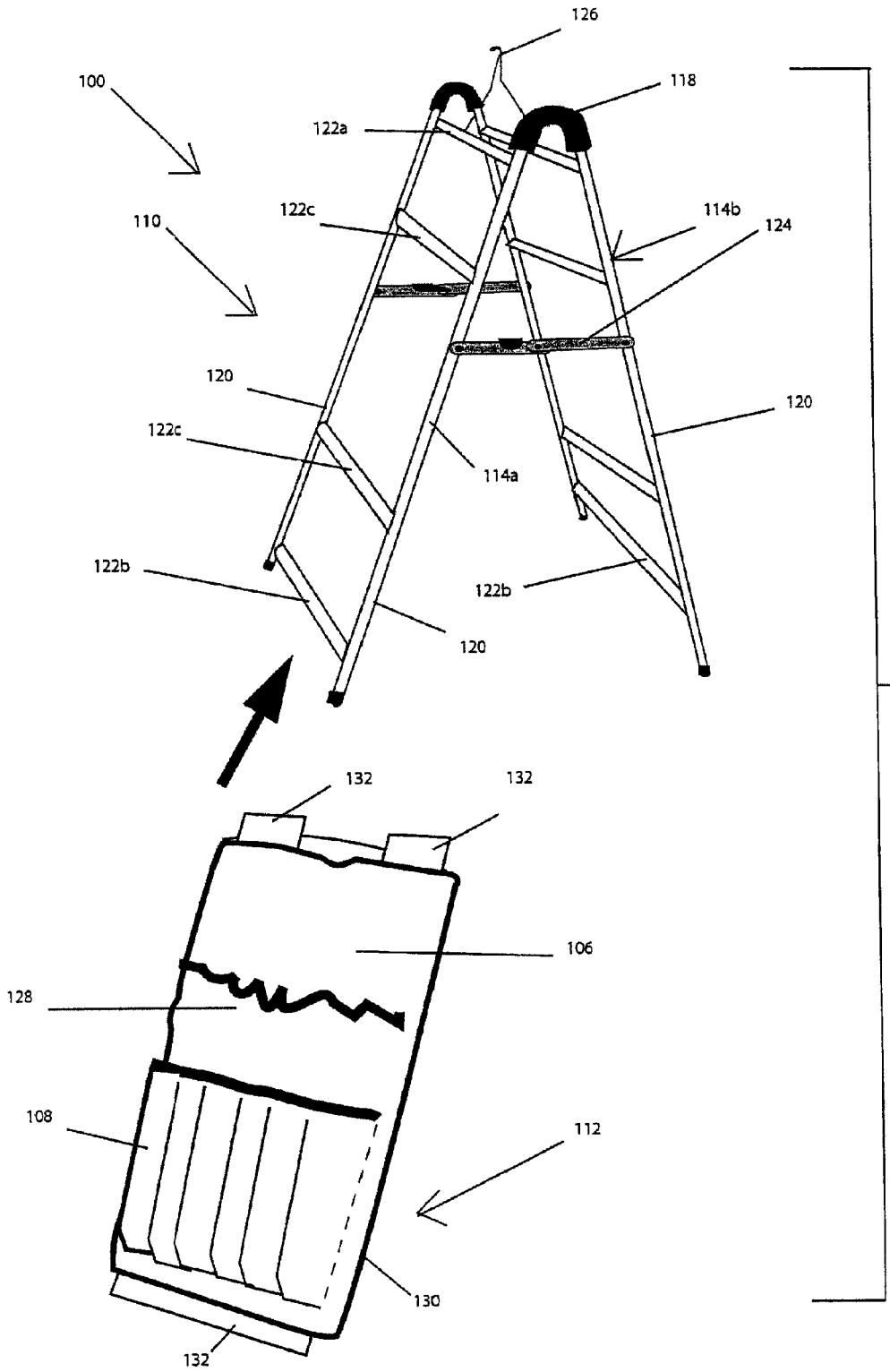
FIG. 3 is an illustration of the storage device in a partially exploded configuration.

FIG. 3 shows an exploded view of a portion of the system 100. The system includes a frame structure 110 and a supply holding portion 112. In this example, the frame structure 110 is an A-frame design having a first side 114*a* and a second side 114*b*, meeting at an apex 118. In this embodiment, each of the first and second sides 114 lie in planes defined by the rigid structure, and are referred herein as planar, although this is intended to encompass non-planar sides that may form an A-frame shape. The rigid structure includes legs 120 defining the A-frame shape and a plurality of horizontal strengthening cross-bar supports 122 connecting and providing stability to the legs 120. In the example shown, the legs 120 of each side are substantially the same length so that the apex 118 is centrally disposed between the leg ends when the A-frame is in its workstation orientation. In the embodiment shown, the legs 120 and supports 122 are formed of a light tubular metal, such as aluminum or steel. In other embodiments, the legs 120 and supports 122 are formed of polymer materials or fiber composites that provide a lightweight frame with a sufficient rigidity to support the supply holding portion 104. In yet other embodiments, the frame structure is a solid sheet component, such as, for example, a sheet of wood or plastic sufficient to provide stability to the system 100. Other materials and frame styles also are contemplated.

In the exemplary embodiment shown, the supports 122 of each of the first and second sides 114 comprise an uppermost support 122*a*, a lowermost support 122*b*, and one or more centrally disposed center supports 122*c*. In the example shown, the uppermost support 122*a* is formed adjacent the apex 118 and the lowermost support 122*b* is formed adjacent the bottom portion of the legs 120.

The legs 120 of the opposing first and second sides 114 meet and are pivotally connected to each other at the apex 118. In some embodiments the legs 120 may be pivotally connected by a pin extending directly through the legs 120, or alternatively, may include a pin connector or other hinge that permits pivoting and holds the legs together at the apex. This connection permits the first and second sides 114 to transform from the free-standing workstation orientation to the collapsed storage orientation. To regulate the pivot range, a connecting mechanism, shown herein as a latch 124, is connected to at least one leg of each of the first and second sides 114. In one embodiment, the latch is pivotally attached to each of the opposing legs and includes a central pivot that allows the latch to collapse with the frame structure 110, yet still limit the distance the frame structure 110 can pivot at the apex 118. In another embodiment, the connecting mechanism may be pivotally attached to one of the opposing legs, and may extend to releasable connect to the other of the opposing legs. Accordingly, the connecting mechanism can be released from one leg to permit the system to collapse, and may be connected to both legs to secure the frame structure 110 in the workstation orientation. The connecting mechanism may be a rigid device, or alternatively may be flexible cable, string, rope, or other tether that limits the range of pivoting of the first side relative to the second side. In some embodiments, the connecting mechanism releasably locks in the workstation orientation such that the device 100 does not easily inadvertently collapse to the storage orientation.

In some embodiments, the connecting mechanism limits pivoting of the first side relative to the second side to less than about 60 degrees, while in others, it limits the pivoting to about 45 degrees. In other embodiments, the pivot range is limited to less than about 30 degrees. Still other embodiments have a pivot range limited to less than about 25 degrees. In some embodiments, the connecting mechanism does not limit the pivot range, but the apex is configured to limit the pivot range to the ranges discussed above.

In the example shown, the frame structure 110 includes a hanger hook 126 extending from a central portion of the uppermost support 122*a*. The hanger hook 126 permits the device 100 to be stored in a standard closet by hanging the device on a closet bar, doorknob, or other location. In one example, the hanger hook 126 extends from the uppermost support 122*a* on only one of the first and second sides 114, while in other examples the hanger hook 126 extends from the uppermost support 122*a* of both the first and second sides 114. In such an example, the hanger hook 126 may be split to accommodate separation of the uppermost supports 122*a* of each side 114, as shown in FIG. 1.

The exemplary supply holding portion 104 in FIG. 3 is configured with the organization features or supply receiving features 108 for receiving supplies, such as gift wrapping supplies. The supply holding portion 112 forms the outwardly facing side 106 and the inwardly facing side 104 of the supply holding sides 102 of the device 100. The supply holding portion 112 attaches to and covers one of the first and second substantially planer sides 114 of the frame 110, with one of the substantially planer sides 114 of the frame structure 110 and the supply holding portion 112 together forming a supply holding side 102 of the device 100, as shown in FIG. 1. A second supply holding portion (not shown in FIG. 3) may attach to and cover the other substantially planer side 114 of the frame structure 110.

In this embodiment, the supply holding portion 112 is formed as a sleeve of flexible material that receives one side 114 of the frame structure 110 therein. Accordingly, as a sleeve, in this example, the supply holding portion 112 is secured along its two lateral edges, such as by being sewn together or wrapped, while the upper and lower ends are open. Accordingly, the supply holding portion 112 includes an outwardly facing front side 128 and an inner facing rear side 130, together encompassing one of the first and second sides of the frame structure 110. Flaps 132 at the upper and lower ends respectively wrap around the uppermost and lowermost supports 122*a*, 122*b* securing the supply holding portion 112 in place. In other embodiments, the lateral sides include flaps 132 that wrap around the frame legs 120 to secure the supply holding portion 112 to the frame structure 110.

In some examples the supply holding portion 112 is formed of a flexible material, such as a woven material onto which storage features may be attached. In one example the flexible material is a canvas sheet material. Other materials also are contemplated, including vinyl, plastics and others.

In one example, the supply holding portion 104 includes a reinforcement element (not shown) disposed in or along the front side 128 of the supply holding portion between the frame structure 110 and the outwardly facing front side 128. This reinforcement element provides a relatively rigid backing to the storage system so that during normal use, the frame supports are not detected through the flexible material when adding to or removing supplies from the system 100.

Figure 4:
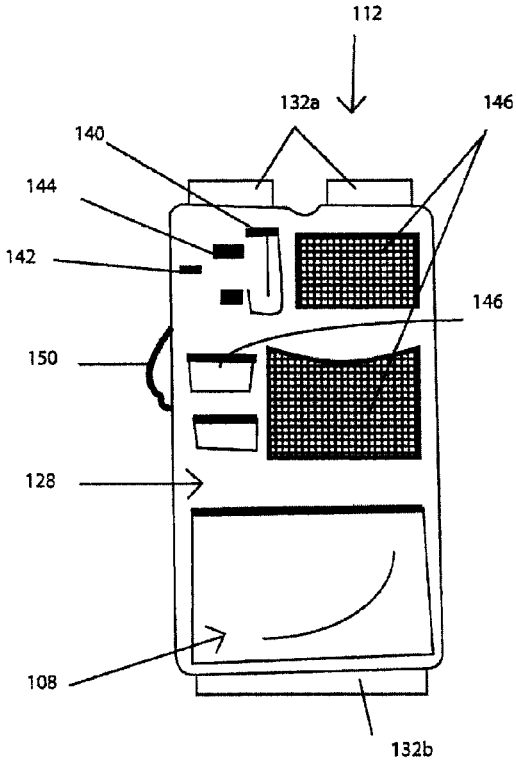
FIG. 4 is an illustration of a front view of an exemplary supply holding portion of the device of FIG. 1.
Figure 5:
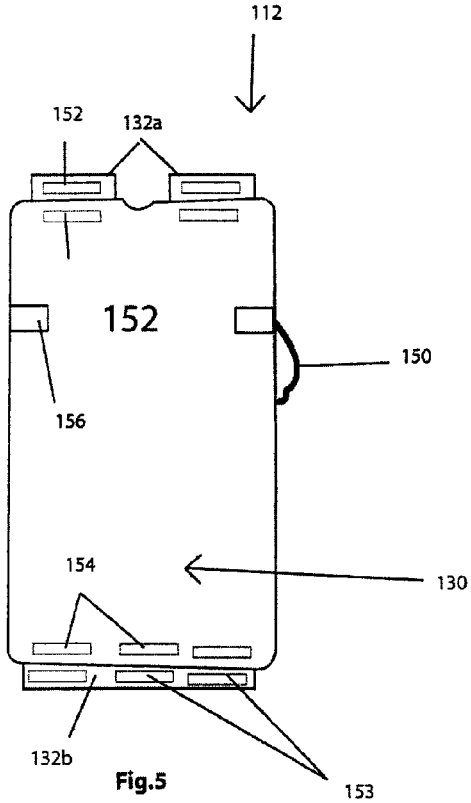
FIG. 5 is an illustration of a back view of an exemplary supply holding portion of the device of FIG. 1.
Figure 6:
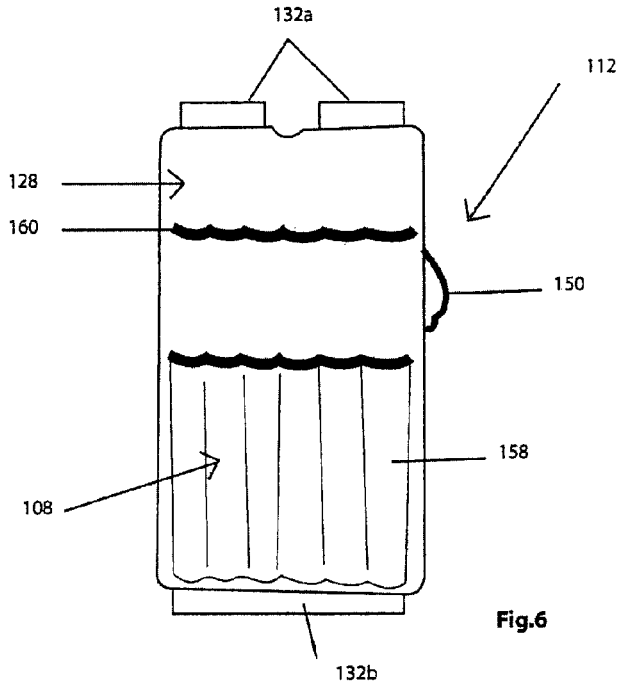
FIG. 6 is an illustration of another front view of an exemplary supply holding portion of the device of FIG. 1.

FIGS. 4-6 show examples of different arrangements of supply holding portions. FIGS. 4 and 6 show outwardly facing sides including storage features 108 for receiving and organizing supplies, while FIG. 5 shows an inwardly facing side 130 connectable to the frame structure 110.

Referring first to FIG. 4, the outwardly facing side 128 of the supply holding portion 112 includes storage features 108 formed of expandable and non-expandable pockets, straps, or other features. In the example shown the storage features include, for example, pen pockets 140, utility straps 142 that may be opened by hook and loop fasteners, arranged straps 144 for holding scissors that include an higher strap forming a first larger loop and a lower strap forming a second smaller loop through which a portion of the scissors extends. In addition the storage features include pockets 146 for receiving supplies. In some embodiments, the pockets may be formed on a stretchable material. In other embodiments, the pockets may be pleated with a stretchable opening rim that permits the pocket to be opened to access the pocket, while being biased toward a closed orientation. In some embodiments, the pockets may be selectively closable, such as with a zippered opening, snaps, buttons, or alternatively, a hook and loop opening. In some embodiments, the pockets are formed of a see-through material, such as a mesh or netting material, while in other embodiments, the pockets may be formed of a canvas material.

At a lateral side edge 148, the supply holding portion 112 includes a handle 150 extending therefrom. The handle 150 allows a user to carry the device from the side. In some embodiments the handle is a flexible strap.

FIG. 5 shows a back or inner side 130 of the supply holding portion 112. This inner side 130 may be the back side of the supply holding portion 112 in contact with one side of the frame structure 110 or alternatively, such as in the sleeve design, may be disposed on the backside of the frame 110, facing inwardly on the A-frame. Referring to FIG. 5, the inner side 130 includes upper flaps 132*a*, a lower flap 132*b*, and a main region 152. Each flap 132 includes one of a hook and loop material 153 of a hook and loop fastener. The main region 152 includes the other of the hook and loop material 154. Accordingly, folding over the flaps 132 connects the hook and loop materials. In use with the frame structure 110 in FIG. 1, the upper flaps 132*a* extend over the uppermost support 122*a* and attach to the back region 152. In the embodiment shown, these flaps 132*a* are spaced apart to accommodate the hanger 126. The lower flap 132*b* is disposed to extend under the lowermost support 122*b* and attach to the back region 152. The inner side of the supply holding portion 112 also includes apertures 156 located to expose the frame structure 110 and accommodate the connecting mechanism in FIG. 1. It should be apparent that in place of a hook and loop fastener, other fasteners, such as snaps, zippers, buttons, or other fasteners could be used.

FIG. 6 shows another front view of an alternative supply holding portion 112. The embodiment in FIG. 6 is similar to the supply holding portion 112 in FIGS. 4 and 5 but includes different storage features for accommodating supplies, such as wrapping supplies. In this embodiment, the supply holding portion 112 includes paper roll storing features, such as relatively cylindrical pockets 158 shaped to receive tubular-shaped objects, such as wrapping paper rolls. These are disposed on the lower region of the supply holding portion. A securing band 160 extends laterally across the upper region of the supply holding portion 112. The securing band 160 may be divided into cylindrical-shaped loops having a diameter size similar to the size of the cylindrical pockets. In some embodiments the cylindrical pockets are aligned.

Figure 7:
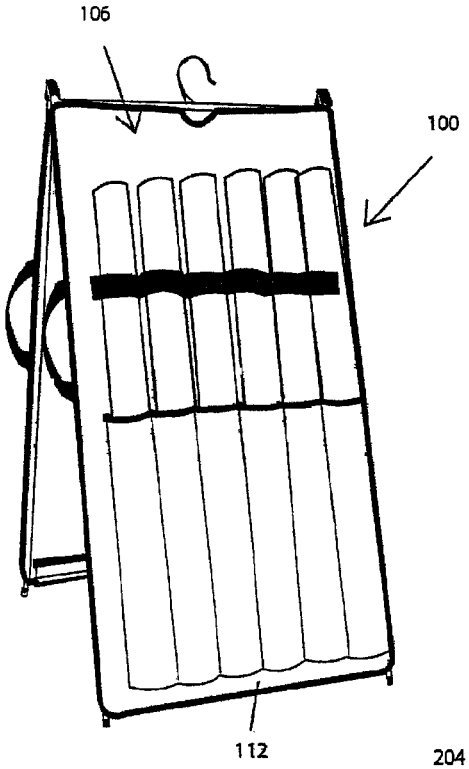
FIGS. 7 and 8 show the opposing sides of the device of FIG. 1 with supplies therein.
Figure 8:
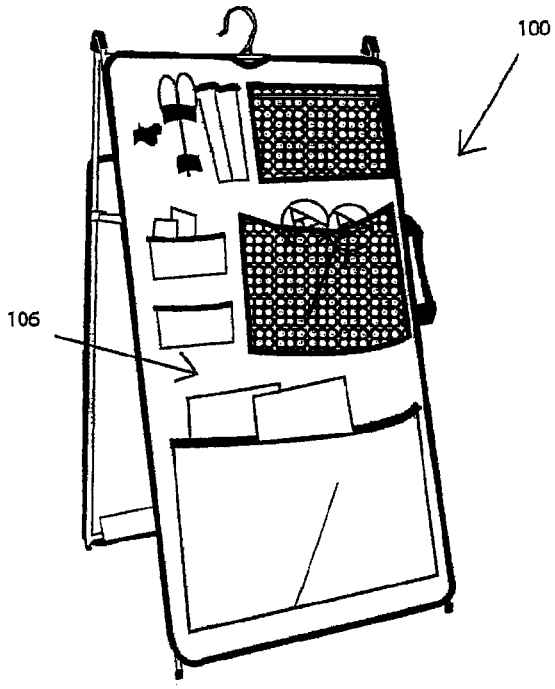

In one embodiment, the supply holding portion of FIG. 4 is disposed on the first frame side 114*a* and the supply holding portion of FIG. 6 is disposed on the second frame side 114*b*. FIGS. 7 and 8 show front and back views of a device filled with gift wrapping supplies, such as paper rolls and other supplies. As shown, the supplies are maintained on the exterior portion or outwardly facing sides 106 of the device, and the device may be transformed from the workstation orientation to the collapsed storage orientation while maintaining the supplies in an accessible position on the outwardly facing sides of the device.

Figure 9:
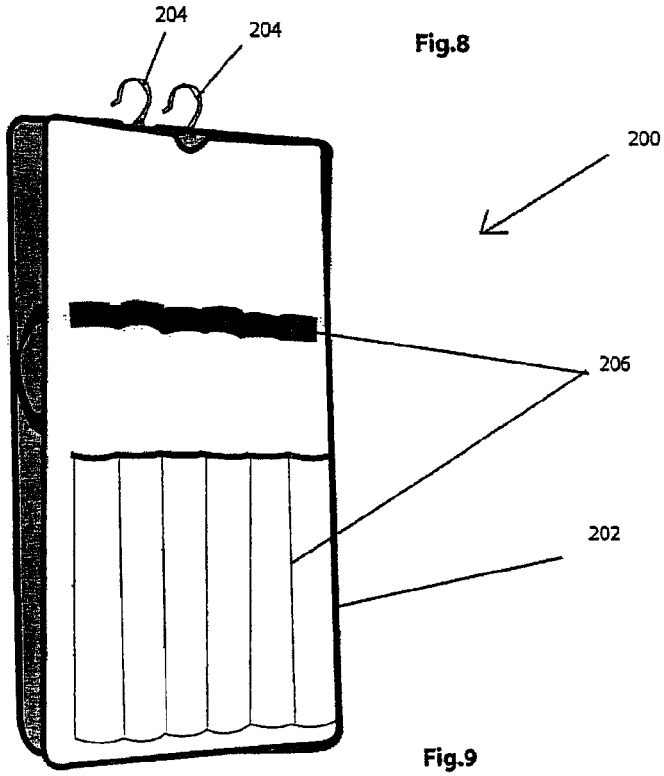
FIG. 9 is an illustration of an exemplary storage device according to a second embodiment of the present disclosure in a workstation orientation.

FIG. 9 shows another exemplary embodiment of a device, referenced herein by the numeral 200. The device 200 may include any of the features disclosed herein with reference to other embodiments. In this example, the A-frame design lies on its side such that an apex 202 is disposed at one of the lateral sides and the hanger 204 extends from the top region. Like the embodiment 100, this embodiments transforms from a storage orientation to a workstation orientation. Here, the supply features 206 are disposed in a direction generally rotated from that of FIGS. 4 and 6.

Figure 10:
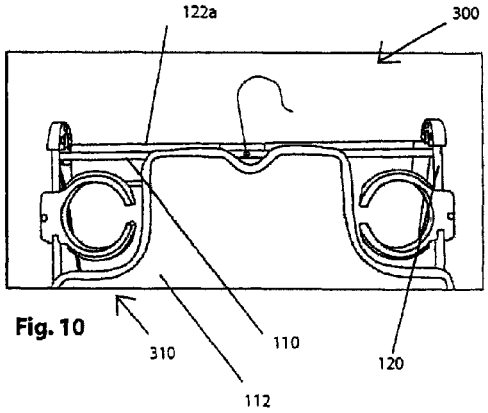
FIG. 10 is an illustration of an exemplary storage device according to a third embodiment of the present disclosure including a wrapping paper dispenser in a workstation orientation.
Figure 11:
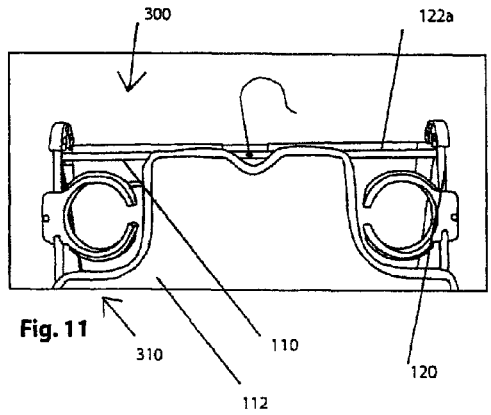
FIG. 11 is an illustration of the exemplary storage device of FIG. 10 with the wrapping paper dispenser in a storage orientation.

FIGS. 10 and 11 show another exemplary embodiment of a device, referenced herein by the numeral 300. The device 300 may include any or all of the features discussed herein with reference to other embodiments. Here, the device 300 includes supply holding sides including the frame structure 110 and supply holding portions 112, but in this embodiment, the supply holding portions 112 are formed to accommodate an optional wrapping paper dispenser system 310.

Figure 14:
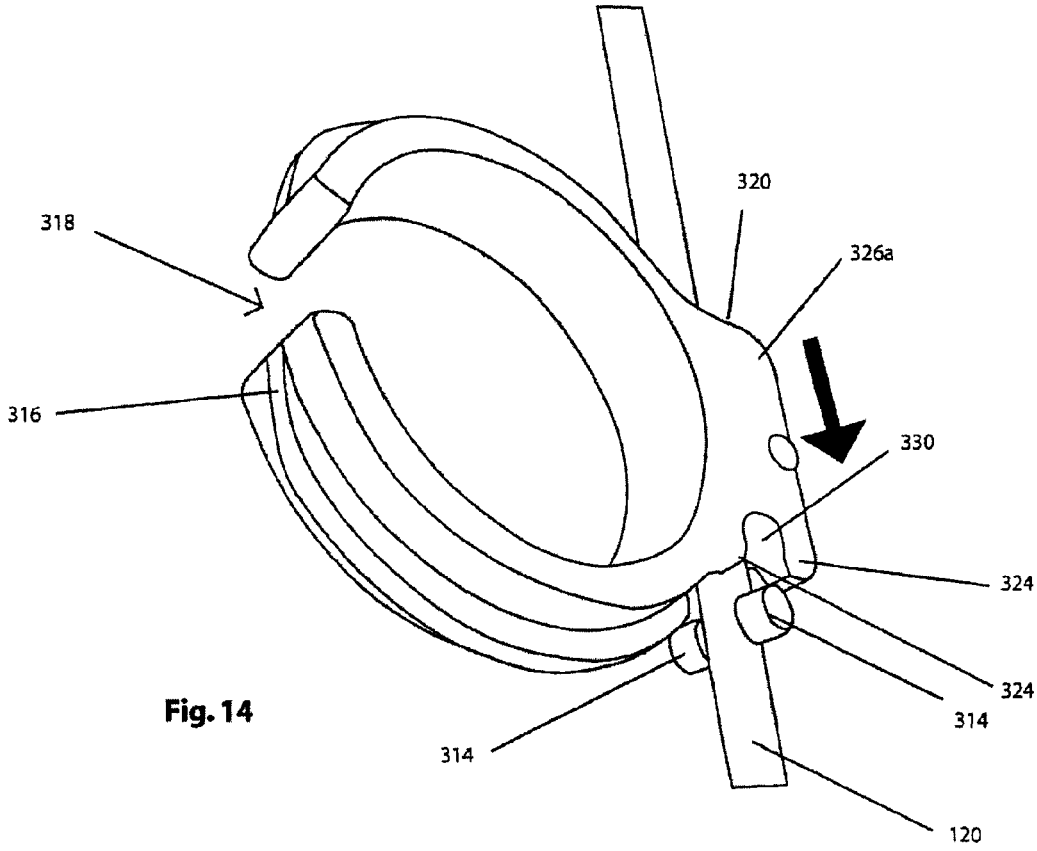
FIGS. 14 and 15 are illustrations showing the dispenser portion of FIGS. 12 and 13 on the frame structure of the storage device.
Figure 15:
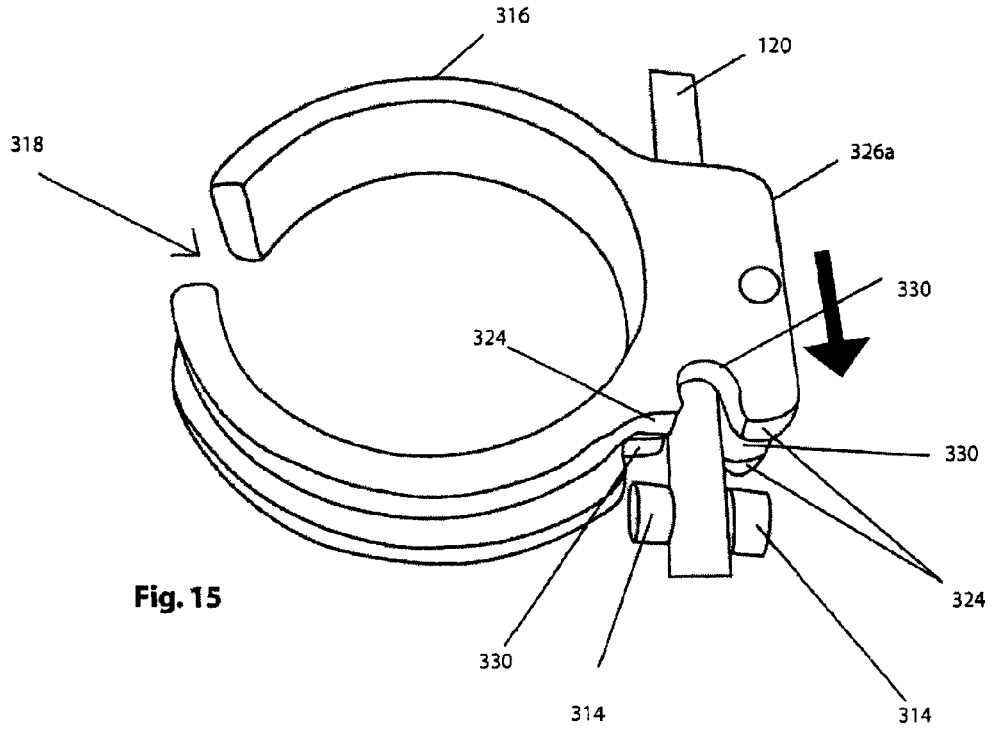

The wrapping paper dispenser system 310 is formed of a plurality of dispenser portions 312, each slidably disposed on one of the legs 120, and is formed of projecting stop anchors 314 immovably secured on the legs 120 (best seen in FIGS. 14-15. Preferably, the dispenser 310 includes at least two dispenser portions 312, and these may be disposed on opposing sides of the frame structure 120, as shown in FIG. 10. The dispenser system 310 is moveable from a deployed or workstation orientation to a storage orientation. As will become more apparent in the below description, the workstation orientation is one where the dispenser portions 312 extend outwardly at an angle from the planar sides of the frame structure 120, while the storage orientation is one where the dispenser portions 312 more closely align, and may lie within the plane defined by sides of the frame structure 110.

Figure 12:
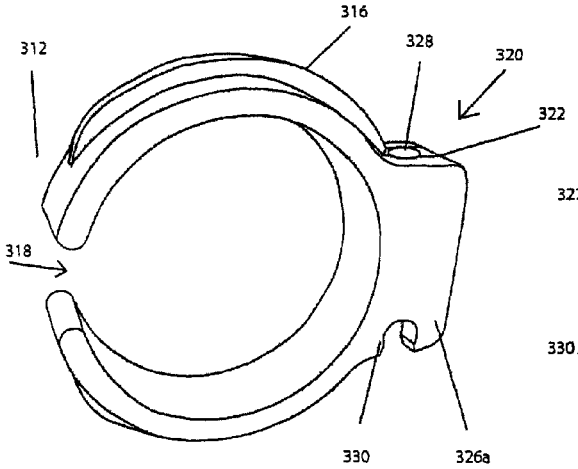
FIGS. 12 and 13 are illustrations of an exemplary dispenser portion of the wrapping paper dispenser of FIGS. 10 and 11.
Figure 13:
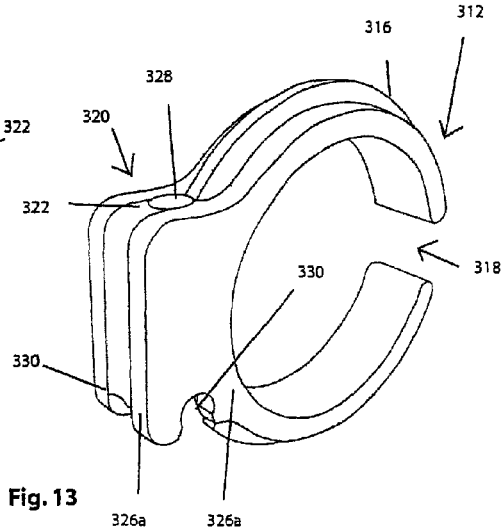

FIGS. 12 and 13 show an example of one of the dispenser portions 312, and FIGS. 14 and 15 show an example of the dispenser portion 312 on the frame leg 120 with the stop anchors 314. Referring to FIGS. 12-15, the dispenser portion 312 in this embodiment includes a paper support 316 with a dispenser opening 318 and includes a base portion 320 for securing to the frame structure 110. The paper support 316 is C-shaped element with the opening in the C-shape forming the dispenser opening 318. The C-shape has a diameter sized to accommodate a wrapping paper roll. The opening 318 is preferably sized smaller than a standard wrapping paper tube so that the tube cannot pass through the opening 318.

The base portion 320 includes a top surface 322, a bottom surface 324, and three side surfaces 326*a-c*. A fourth side of the base portion 320 connects with the C-shaped paper support 316. An aperture 328 extends through the base portion 320 from the top surface to the side surface. The bottom surface 322 includes four slots 330, spaced 90 degrees apart from each other, and radially formed about the aperture 128. In some examples, the slots 330 are key-hole shaped, meaning they have a greater width at the end than at the opening.

Referring to FIG. 14, the stop anchors 314 extend in a direction perpendicular to an axis of the leg 120 of the frame structure 110 from opposing sides of the leg 120. These stop anchors 314 form a seat on which the dispenser portion 312 can rest. The stop anchors 314 may have a diameter similar to that of the leg 120, or alternatively, may be larger or smaller, but are sized to fit within the slots 330 of the base portion 320 of the dispenser portion 312.

The dispenser portion 312 selectively locks onto the stop anchors 314 by sliding the dispenser portion 312 along the leg 120 so that the stop anchors 314 slide into the slots 330 on the base portion 312. This locks the dispenser portion 312 in place on the leg 120, such that the dispenser portion cannot rotate about the leg portion and cannot slide further downward along the leg 120.

As indicated above, the dispenser portion 312 may be secured in either a workstation orientation or in a storage orientation. It changes from one orientation to the other by rotating about the leg 120 between a protruding condition and an aligned condition. FIG. 14 shows the dispenser portion 312 being deployed in the workstation orientation by moving the dispenser portion downward as shown by the arrow to receive the stop anchors 314 in the slots in the workstation orientation. In this orientation, the dispenser portion extends in a direction relatively perpendicular to the planar side formed by the frame structure 110.

In contrast, FIG. 15 shows the dispenser portion 312 being deployed in the storage orientation by moving the dispenser portion 312 downward along the leg 120 as shown by the arrow to receive the stop anchors 314 in the slots in the storage orientation. In this orientation, the dispenser portion lies within the plane formed by the planar side of the frame structure 110.

In some embodiments, the base portion 320 and the C-shaped paper support 316 are integrally formed of a single piece of material, such as a molded or machined plastic. In other embodiments, they comprise separate pieces assembled together. The base portion may be formed of more than one piece in order to easily accommodate machining of the piece. A variety of arrangements are contemplated.

In use, a user may place gift wrapping supplies in the supply storage features. For example, the user may place wrapping paper and other supplies, such as, for example, tape, ribbons, bows, labels, scissors, glue, and other similar gift wrapping supplies. Accordingly, the gift wrapping supplies are disposed at the exterior or outwardly facing sides of the device. Because of the A-frame design, the user can pivot the opposing supply holding sides between the work station orientation and the storage orientation. Therefore, when the user intends to use the supplies, she may pivot the supply holding sides from the storage orientation, where the sides are substantially parallel, to the workstation orientation, where the sides are angled relative to each other. The degree of pivoting may be limited by the connection mechanism. In some embodiments, the user locks the device in the workstation orientation using the connection mechanism. Because of its A-frame design, the device free-stands on the floor, with both the supply holding sides in either a vertical or angled orientation, depending on the design. After use, the user replaces the supplies, collapses the device to the storage orientation, and hangs the device from the hanger for storage until the next use.

When used with the wrapping paper dispenser in FIGS. 10-15, a roll of wrapping paper is slid through the C-shaped diameters of both the dispensing portions when in the workstation orientation as shown in FIG. 16. The paper edge may be fed out the opening 318 as shown in FIG. 17 so that a user can dispense the paper in any desired length, then cut the paper from the roll. When a wrapping project is complete, the user may remove the roll from the dispensing portions and change the orientation of the dispensing portion from the workstation orientation to the storage orientation. This is done by sliding the dispensing portion upward to disengage the stop anchors 314 from the dispensing portion slots, rotating the dispensing portion 90 degrees about the leg 120, and sliding the dispensing portion downward to engage the stop anchors 314 into the previously empty slots, as shown in FIG. 11. The paper removed from the dispensing portions 312 may be placed within the supply storage features.

Figure 18:
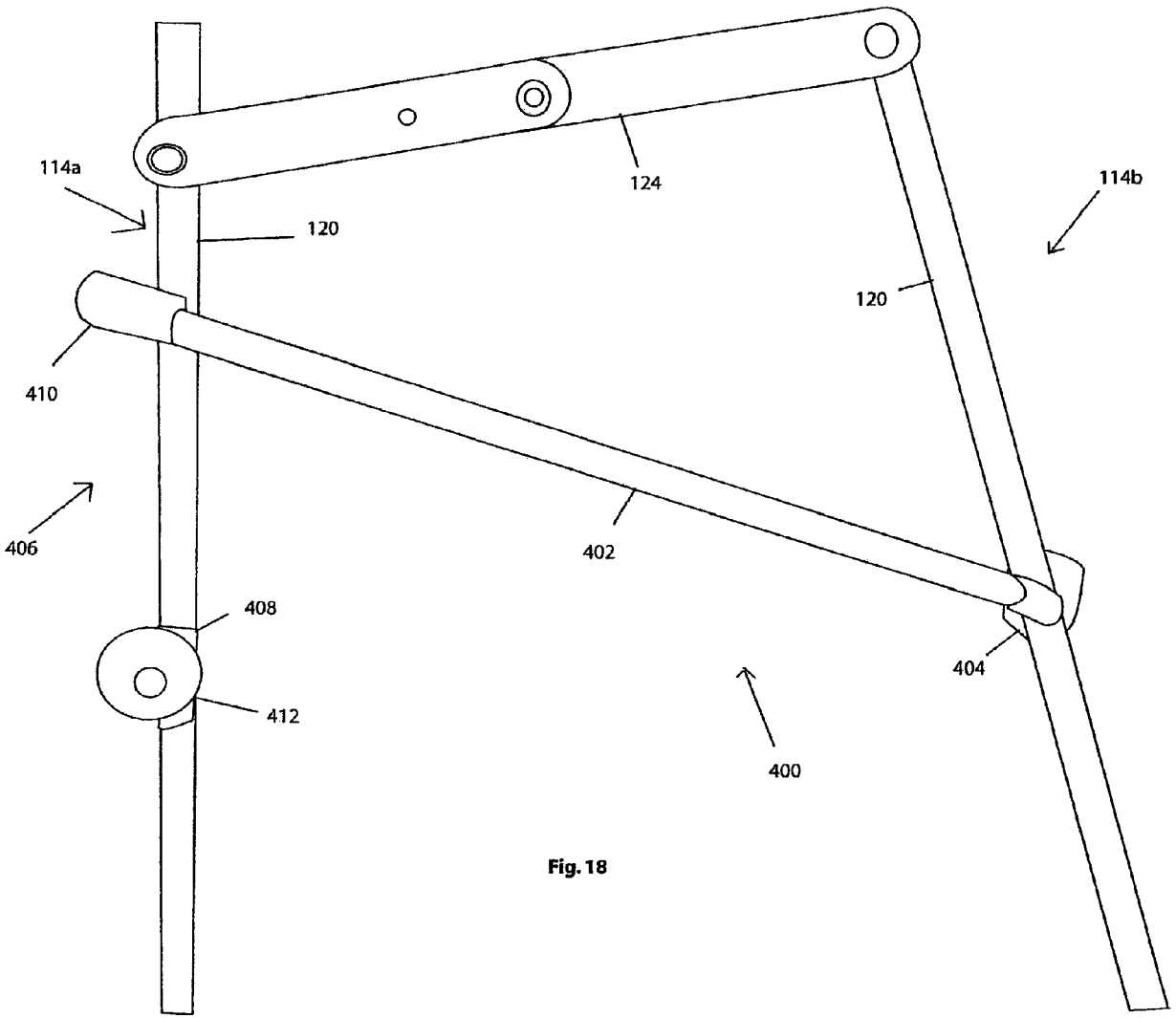
FIG. 18 is an illustration showing an exemplary ribbon dispenser usable on the storage device of FIG. 1.

FIG. 18 shows an exemplary supply dispenser 400 that may be used for holding and dispensing supplies such as, ribbon rolls, tape rolls, or other items. In the embodiments shown, the supply dispenser 400 extends from one leg 120 to the other of the opposing first and second sides 114*a*, 114*b*. In this example, the supply dispenser 400 comprises a ribbon roll dispenser as a supply arm 402, a universal connector joint 404, and a latch system 406. The universal joint 404 connects the supply arm 402 to one of the legs 120, but also permits the supply arm 402 to pivotally move relative to the leg 120 in all dimensional planes. Accordingly, in the examples where each of the first and second sides 114 lie in planes defined by the rigid structure, the joint 404 permits the supply arm 402 to pivotally rotate in a plane transverse to the first and second sides, but also to pivot so that the arm 402 lies substantially within or parallel to the plane of the first and second sides.

In this example, the latch system 406 comprises a stop 408 and a latch 410 that interfaces with the stop 408. The stop 408 protrudes outwardly transverse to the leg 120 and is a seat for the latch 410. The latch 410 is disposed on the arm 402 spaced from the joint 404 to align with and connect to the stop 408 when the frame structure 110 is in its workstation orientation.

In this embodiments the stop 408 is cylindrical having a curved outer surface. A corresponding concave curve is formed on the latch 410. It is contemplated however, that the stop 408 may have any crossectional shape and the latch may be similarly formed. In this exemplary embodiment, in order to maintain the latch 410 on the stop 408, the stop 408 includes a flange 412 that mechanically obstructs latch movement in a horizontal plane.

In use, a user may deploy the organization system 100 to the workstation orientation. Ribbon rolls, tape rolls, or other supplies may be slid over the latch 410 to lie on the supply arm 402. The universal joint 404 makes this easy, as the user can manipulate the arm 402. The arm 402 is then oriented to latch the arm to the leg 120 so that the arm lies in a relative horizontal plane, supporting the ribbon rolls for simple and convenient access. When the project is complete, the latch may be disengaged, the ribbon may be removed, and the arm may hang from the joint 404. The system 100 may be closed to the storage orientation with the arm 402 hanging adjacent to the frame leg 120.

Figure 19:
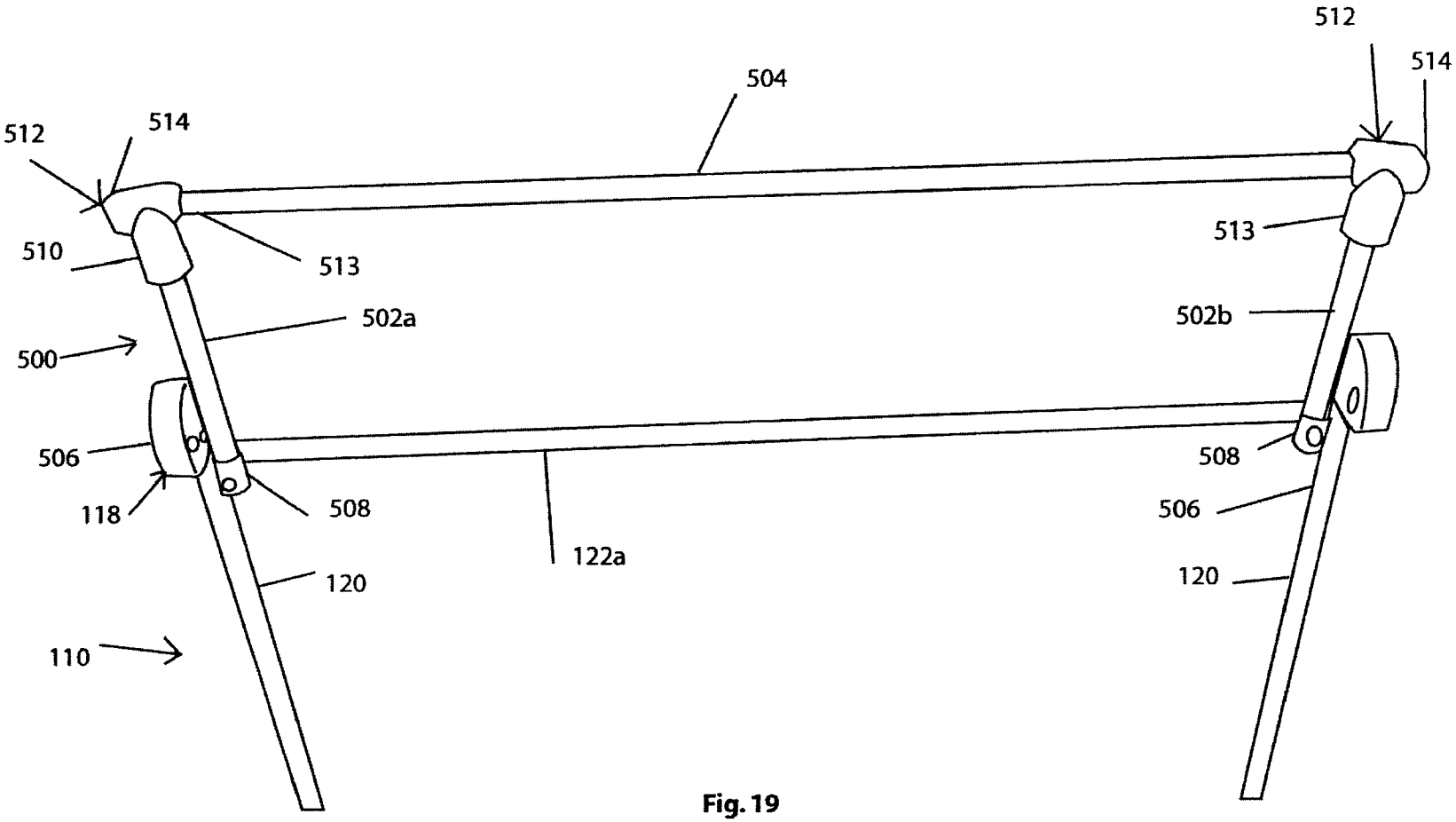
FIGS. 19-21 are illustrations showing another exemplary ribbon dispenser usable on the storage device of FIG. 1.
Figure 20:
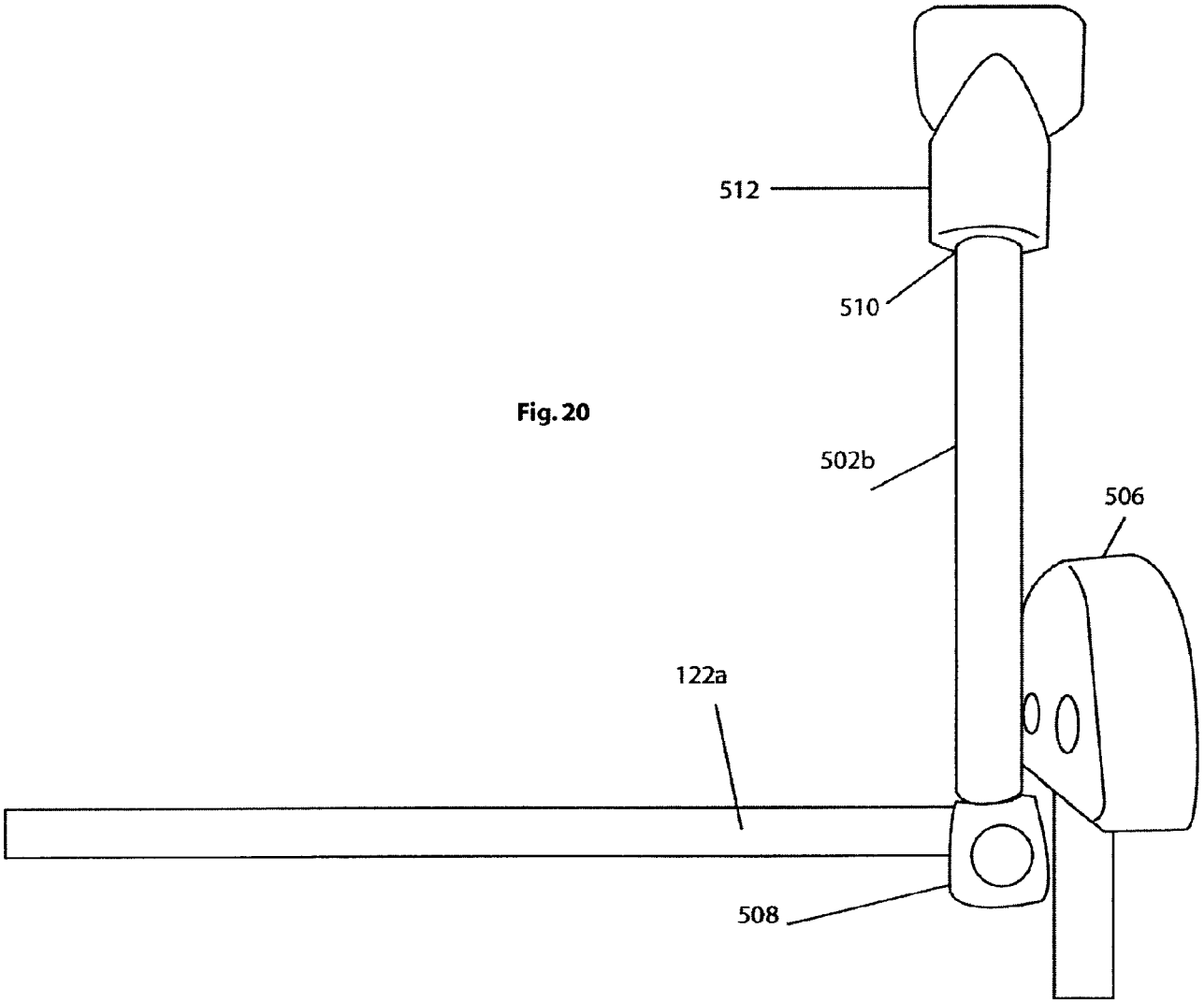
Figure 21:
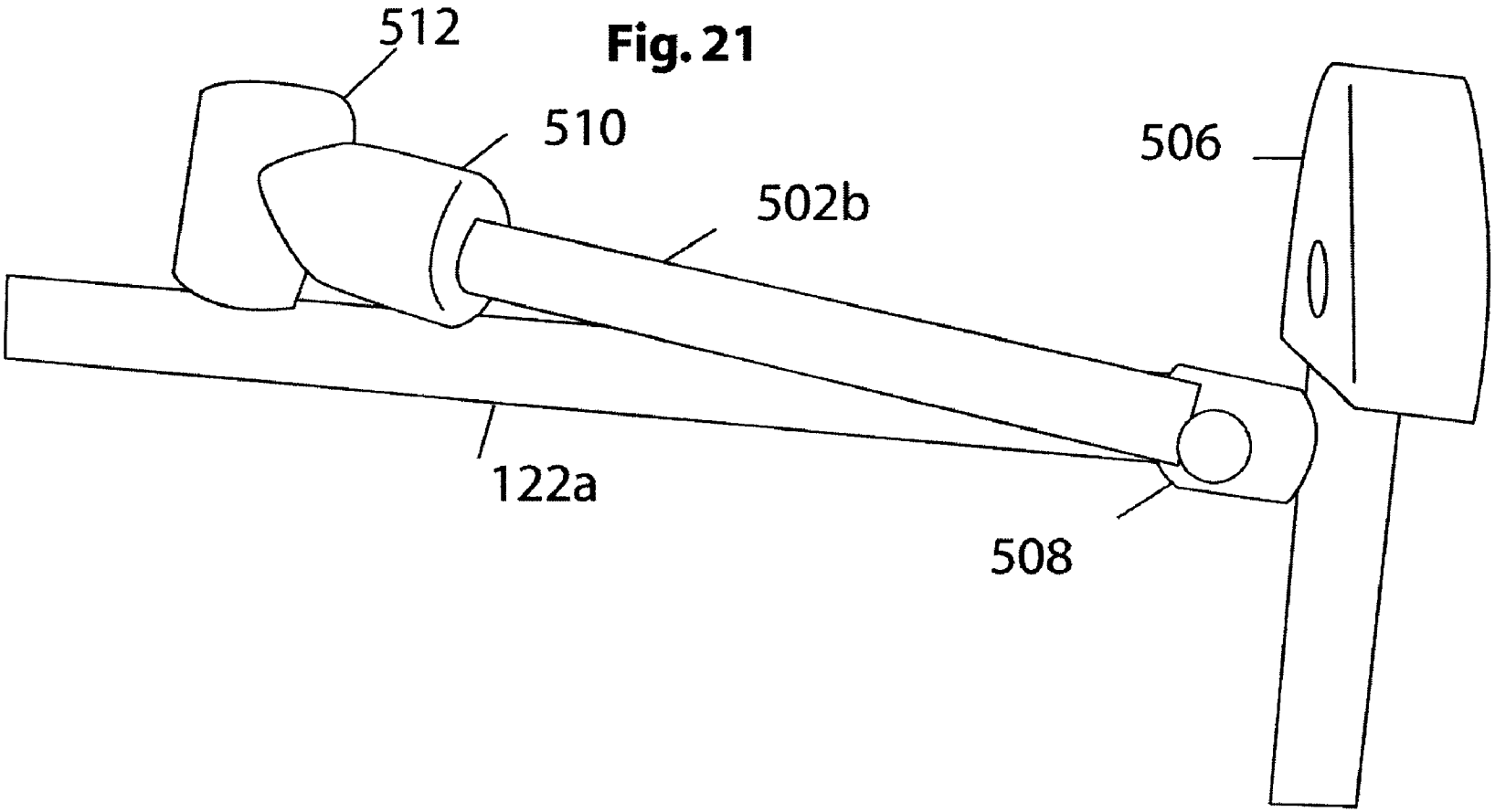

FIGS. 19-21 show another exemplary supply dispenser, referenced herein by the numeral 500. In this embodiment, the supply dispenser 500 connects to the frame structure 110 along the uppermost support 122*a*. Here, the supply dispenser 500 comprises two supporting members 502*a*, 502*b* and a supply arm 504. A connector 506 permits pivoting and holds the legs 120 together at the apex 118.

In the example shown, the supporting members 502*a*, 502*b* are disposed adjacent the legs 120 and have first and second ends 508, 510, with the first ends 508 pivotally attached to the uppermost support 122*a*. These may be attached at the first end 508 by a pin connection that permits the supporting members 502*a*, 502*b* to pivot from extending in a relatively vertically-extending position, or a workstation orientation, to a relatively horizontally-extending position, or a storage orientation. The second ends 510 include an arm receiving element 512 that releasably receives the supply arm 504. As shown in FIG. 19, the arm receiving element 512 has a shaped recess 513 and a back wall 514 that limits the movement of the arm relative to the receiving element 512. In some embodiment, the arm receiving element 512 is a component that is configured to receive a rod portion of the uppermost support 122 in the manner shown in FIG. 20.

As with the prior embodiments of the organization device 100, the supply dispenser has both a storage and a workstation orientation. The workstation orientation is shown in FIGS. 19 and 20, with the supporting members 502 in a relatively vertical position and situated to receive and support the supply arm 504. The storage orientation is shown in FIG. 21, with the supporting members 502 in a relatively horizontal position. The supporting members 502 pivot about the connection on the at the uppermost support 122*a* between these two orientations. In some embodiments, the supporting members 502 are in the workstation orientation when they are pivoted to lie against the connector 506. Thus, the connector 506 may form a stop that limits the pivot range of the supporting members 502. In some embodiments, the supporting members 502 are in the storage orientation when they are pivoted so that the arm-receiving element 512 lies against the uppermost support 122*a* of the frame structure 110.

In this embodiment, the supply arm 504 is a rigid rod sized to extend from the second end 510 of one supporting member 502 to the second end 510 of the other supporting member 502. It fits neatly into the shaped recess 513 of each arm receiving element 512.

The connectors 506 secure the legs 120 together at the apex 118 in a manner similar to that described above. In FIGS. 19-21, however, only a single side of the device is shown, and therefore, the legs are not shown connected therefore. This is done for clarity. In some embodiments, these connectors 506 also include a rod receiving recess (not shown) similar to that of the shaped recess 513 of the arm-receiving element 513. Using such a recess, the connector 506 may comprise a storage solution for the supply arm 504.

In use, a user may deploy the organization system 100 to the workstation orientation. The hanger hook 126 may be pivoted down, and the supporting members 502*a*, 502*b* are pivoted up to a substantially vertically-extending position, as the workstation orientation. One end of the supply arm 504 is placed within the arm-receiving element 512 on one the supporting members 502, and ribbon rolls, tape rolls, or other supplies may be slid over the other end of the supply arm 504. That end is then placed in the arm-receiving element 512 on the remaining supporting member 502. The user then has simple and direct access to the supplies, such as the ribbon rolls. When the project is complete, the arm 504 can be removed, the supplies may be taken off and stored in the pockets, and the arm 504 may be placed in the connector 506 for storage. In some examples, the system 100 includes a pocket along one of the first and second sides for receiving and storing the arm 504 when not in use.

In the embodiment shown, the supply dispenser 500 accommodates ribbon rolls having a diameter of up to six inches. Accordingly, in this example, the supporting members project at least 3 inches above the support 122*a*. Other heights, higher and lower are contemplated.

Figure 22:
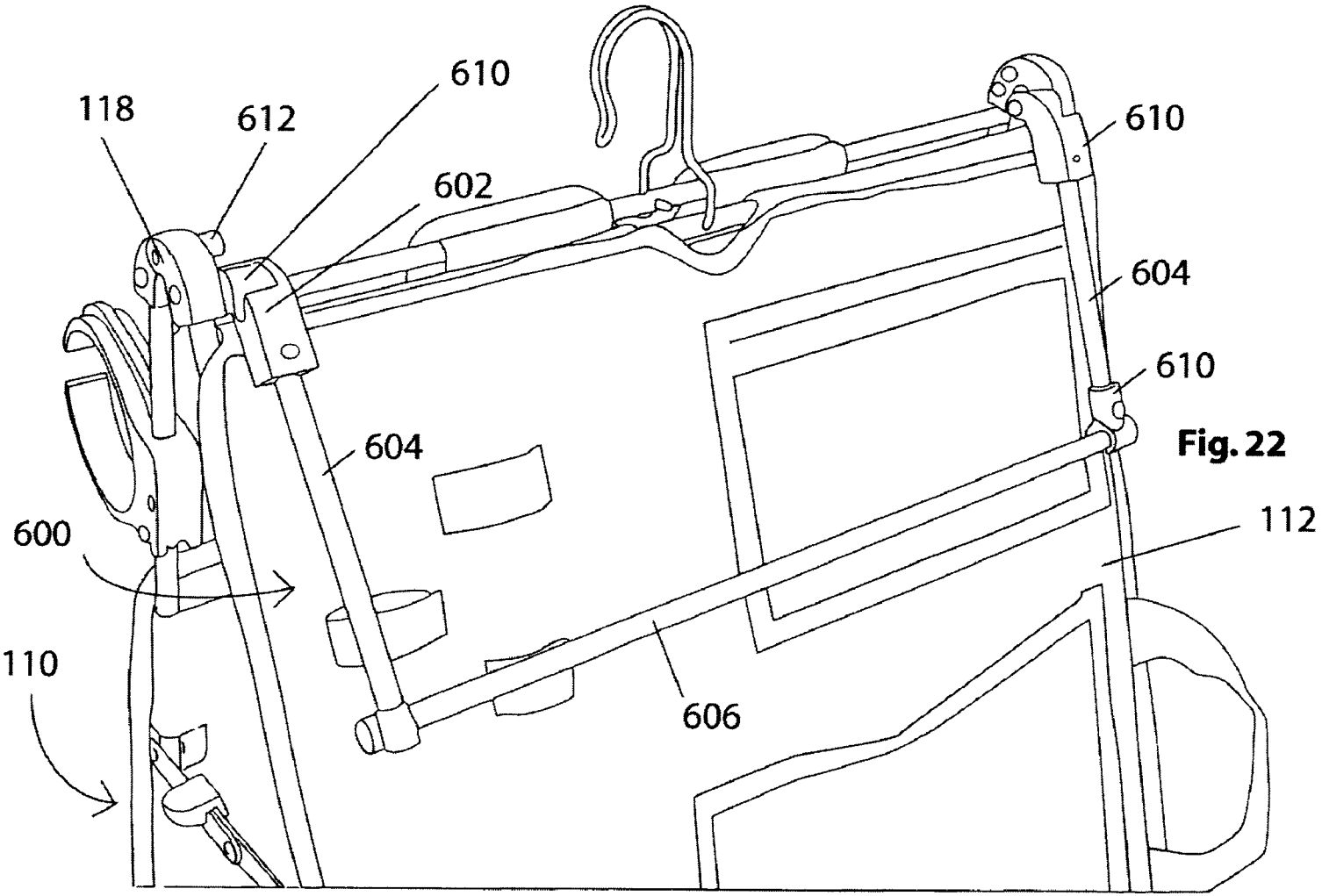
FIGS. 22 and 23 are illustrations showing another exemplary ribbon dispenser usable on the storage device of FIG. 1
Figure 23:
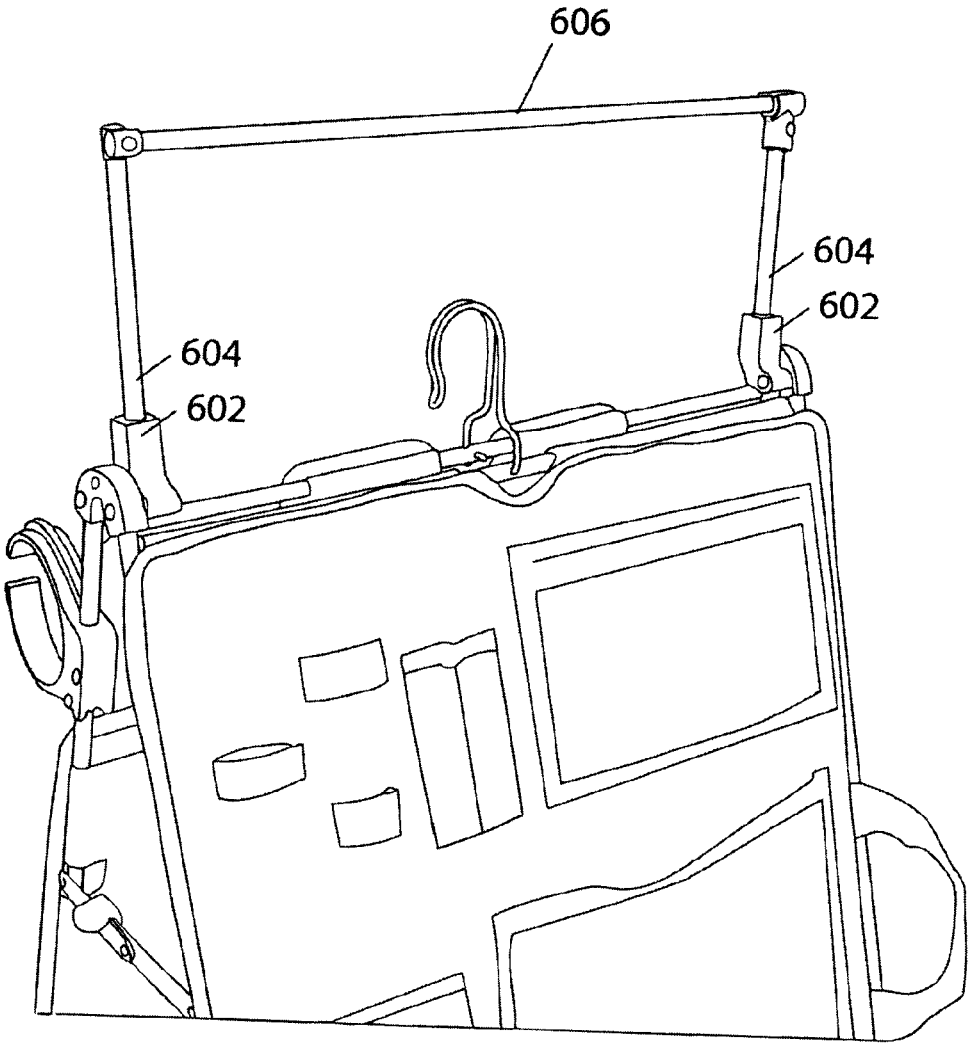

FIGS. 22 and 23 show another exemplary supply dispenser, referenced herein by the numeral 600. In this embodiment, the supply dispenser 600 connects to the frame structure 110 at or adjacent the apex 118. The dispenser 600 includes connector 602, support members 604, and a supply arm 606. The dispenser 600 pivots between a storage orientation (FIG. 22), where the dispenser is pivoted downward to rest adjacent the supply holding portion 112, and a workstation orientation (FIG. 23), where the dispenser 600 is as shown extending upwardly. The supply arm 606 connects with and extends between the support members 604. In the embodiment shown, one end of the supply arm 606 connects to the support member 604 via a pivot or hinge connection while the other end rests in an arm receiving element 610 in the manner described above. In other embodiments, the arm 606 removably connects with both the support members 604.

The connector 602 pivotly attaches the frame structure 110 via the connector at the apex. As shown in FIG. 22, the connector 602 includes a recess 610 shaped to receive a pivot stop 612 that limits the pivot range of the dispenser 600. Other embodiments do not include the recess, but the outer surface of the connector 602 abuts the stop 612. Yet other embodiments use other ways for limiting the pivot range of the dispenser 600.

Ribbon rolls, tape rolls, or other supplies may be slid over one end of the supply arm 606 and maintained there during any project. If desired, when the project is complete, the supplies may be placed in the pockets and the dispenser 600 may be folded down to the storage orientation.

Some embodiments of the device 100 includes wheels, such as castors disposed at the bottom of each leg 120. In these embodiments, the device 100 may be rolled along a floor from one location to another and may be spun around to provide access to the opposite side. In some embodiments, the wheels are disposed on the legs 120 of only one side. The wheels also may be larger wheels, such as wheels suitable for outdoor use that may aid in moving the device from one location to another.

It is contemplated that the devices disclosed herein also may be used for the organization and storage of craft supplies. For example, the devices may be used to accommodate markers, glues, cutting items like scissors and knives, stickers, dowels, and other craft supplies. In one such embodiment, the outwardly facing surfaces include supply holding features on both sides that are suitable for crafts. For example, instead of relatively cylindrical pockets 158 shaped to receive tubular-shaped objects, the device may include supply receiving features such as "pen/marker" pockets, glue stick sleeves, hot glue gun pockets, stamps, scrap-booking supplies, features for attaching and/or storing other items.

In yet another embodiment, the device disclosed herein may be used as a tool caddy. In this embodiment, the supply receiving features may include straps and pockets for screwdrivers, wrenches, pliers, hammers, and other tools. It may also have connectors and pockets for the storage of screws, nails, and other fasteners.

In yet another embodiment, the device disclosed herein is configured as a sewing or quilting version. In one such embodiment, the device may be relatively compact, such as 12"-15" tall to more easily fit on a table adjacent a sewing machine. It may have supply holding features specifically configured to hold thread, needles, thimbles, patterns, and other supplies. In other such embodiments, the device may be larger to accommodate individual fabric pieces.

In yet another embodiment, the device disclosed herein may be used for equipment storage. In some examples, the device may be used for sports equipment storage, such as baseball equipment, for example. One such embodiment includes supply receiving features that may be tubes that accommodate bats on one side, and supply receiving features that accommodate batting gloves, balls, and other equipment on the other. This version may have wheels to facilitate easy movement from the parking lot to the ball field.

In yet another embodiment, the device disclosed herein may be used for equipment storage, such as camping equipment. This embodiment includes, for example, a paper towel holder, plate and silverware pockets, fire equipment holders, and other camping equipment holders.

In yet another embodiment, the device disclosed herein may be used for equipment storage, such as for car care supplies. This embodiment includes, for example, mesh pockets to hold wax, sponges, brushes, cleaning supplies, hose connectors. One embodiment also includes a hose caddy. A similar embodiment is used for cleaning supplies such as window cleaners, bathroom cleaners, cleaning gloves, towel holders, and other supplies.

The devices disclosed herein provide practical and convenient organization, storage, and access to the supplies required to complete the specific task or project. They not only provide for logical and organized storage of all supplies, but they may position all required supplies in one area so that all items needed for the project are instantly accessible for ease of use, at less than an arm's length away.

Applicants note that the use of directional terms herein, such as upper, lower, lateral, and others are merely exemplary, and may encompass other directions, such as the device being on its side, unless so indicated. Although several selected embodiments have been illustrated and described in detail, it will be understood that they are exemplary, and that a variety of substitutions and alterations are possible without departing from the spirit and scope of the present invention, as defined by the following claims.

I claim:

1. A wrapping paper storage and organization system, comprising:

a first supply holding side having:

a plurality of longitudinally extending wrapping paper roll-receiving pockets, each of the wrapping paper roll-receiving pockets having an upper pocket opening and a pocket bottom, the wrapping paper roll-receiving pockets being relatively cylindrically-shaped and sized to receive at least a portion of a cylindrical wrapping paper roll;

a securing band disposed above at least one pocket opening of the plurality of longitudinally extending wrapping paper roll-receiving pockets and extending in a lateral direction relative to the wrapping paper roll-receiving pockets, the securing band forming a loop aligned with a respective cylindrical pocket of the plurality of wrapping paper roll-receiving pockets to help secure a wrapping paper roll disposed in one of the wrapping paper roll-receiving pockets; and a second supply holding side having a plurality of supply receiving features sized to receive wrapping supplies, the first and second supply holding sides being pivotally connected to each other and being pivotable between a workstation orientation and a storage orientation, the workstation orientation being a orientation where the first and second supply holding sides form an angle and the storage orientation being a orientation where the first and second sides are substantially parallel, the first and second supply holding sides each having an inwardly facing surface facing the opposing supply holding side and an outwardly facing surface facing away from the opposing supply holding side, the plurality of wrapping paper roll-receiving features and the plurality of supply receiving features being disposed on the outwardly facing surfaces of the respective first and second supply holding sides.

2. The system of claim 1, comprising an A-frame structure having a pivotable apex connecting the first and second supply holding sides, the first and second supply holding sides each comprising a leg of the A-frame structure.

3. The system of claim 1, comprising a hanger hook disposed at an edge of at least one of the first and second supply holding sides.

4. The system of claim 1, comprising a connecting mechanism extending between the first and second supply holding sides, the connecting mechanism limiting a pivot range of the first and second sides.

5. The system of claim 4, wherein the connecting mechanism is structurally configured to releasably lock the first and second supply holding sides in the workstation orientation.

6. The system of claim 1, wherein each of the first and second supply holding sides comprises a frame structure and a supply holding portion, the frame structure of each of the first and second supply holding sides providing stability to the system, the supply holding portion being a flexible material disposed about the frame structure.

7. The system of claim 6, wherein the flexible material is secured to the frame structure using a hook and loop fastener.

8. The system of claim 6, wherein the flexible material is formed as a sleeve that receives the frame structure.

9. The system of claim 6, wherein the frame structure comprises an uppermost support, a lowermost support, and a hanger hook extending from the uppermost support.

10. The system of claim 6, further comprising a handle extending from the flexible material for grasping by a user.

11. The system of claim 1, comprising a wrapping paper dispenser.

12. The system of claim 11, wherein the wrapping paper dispenser comprises a plurality of C-shaped dispenser portions pivotable about an axis between a workstation orientation and a storage orientation.

13. A wrapping paper roll storage and organization system, comprising:

a collapsible A-frame portion providing structural support to the system, the frame portion having first and second substantially planar sides pivotable about an apex between a first workstation orientation and a second storage orientation, the first workstation orientation being a orientation where the first and second sides form an angle and the second storage orientation being a orientation where the first and second sides are substantially parallel;

a flexible first supply holding portion secured onto the first substantially planar side of the frame, the first supply holding portion comprising a plurality of longitudinally extending wrapping paper roll-receiving pockets, each of the wrapping paper roll-receiving pockets having an upper pocket opening and a pocket bottom, the wrapping paper roll-receiving pockets being relatively cylindrically-shaped and sized to receive at least a portion of a cylindrical wrapping paper roll;

a securing band disposed above at least one pocket opening of the plurality of longitudinally extending wrapping paper roll-receiving pockets and extending in a lateral direction relative to the wrapping paper roll-receiving pockets, the securing band forming a loop aligned with a respective cylindrical pocket of the plurality of wrapping paper roll-receiving pockets to help secure a wrapping paper roll disposed in one of the wrapping paper roll-receiving pockets; and a flexible second supply holding portion secured onto the second substantially planar side of the frame, the first and second supply holding portions each having an inwardly facing side facing the opposing supply holding portion and an outwardly facing surface facing away from the opposing supply holding portion, the first and second supply receiving features being disposed on the outwardly facing surface of the respective first and second supply holding portions.

14. The system of claim 13, comprising a hanger hook disposed at an edge of at least one of the first and second substantially planar sides.

15. The system of claim 13, comprising a connecting mechanism extending between the first and second substantially planar sides, the connecting mechanism limiting the pivot range of the first and second substantially planar sides.

16. The system of claim 15, wherein the connecting mechanism is structurally configured to releasably lock the first and second supply holding sides in the workstation orientation.

17. The system of claim 13, wherein the flexible first and second supply holder portions are secured to the frame portion using hook and loop fasteners.

18. The system of claim 13, wherein each of the first and second supply holding portions is a sleeve that receives one of the first and second substantially planar sides of the frame portion.

19. The system of claim 13, wherein each of the first and second substantially planar sides comprises an uppermost support, a lowermost support, and a hanger hook extending from the uppermost support.

20. The system of claim 13, further comprising a handle extending from the flexible material for grasping by a user.

21. The system of claim 13, comprising a wrapping paper dispenser.

22. The system of claim 21, wherein the wrapping paper dispenser comprises a plurality of C-shaped dispenser portions pivotable about an axis between a workstation orientation and a storage orientation.

23. A storage and organization system for supplies, comprising:

a rigid frame portion providing structural support to the system, the frame portion having first and second substantially planar sides pivotable about an apex between a first workstation orientation and a second storage orientation, the first workstation orientation being an orientation where the first and second sides form an angle and the second storage orientation being a orientation where the first and second sides are substantially parallel, each of the first and second substantially planar sides having an uppermost support and a lowermost support;

a hanger hook connected to and extending from the uppermost support of the frame;

a connecting mechanism extending between the first and second substantially planar sides and being configured to limit the pivot range of the first and second substantially planar sides;

a flexible first supply holding portion secured onto the first substantially planar side of the frame, the first supply holding portion including first supply receiving features thereon, the first supply receiving features comprising a plurality of longitudinally extending wrapping paper roll-receiving pockets, each of the wrapping paper roll-receiving pockets having an upper pocket opening and a pocket bottom, the wrapping paper roll-receiving pockets being relatively cylindrically-shaped and sized to receive at least a portion of a cylindrical wrapping paper roll;

a securing band disposed above at least one pocket opening of the plurality of longitudinally extending wrapping paper roll-receiving pockets and extending in a lateral direction relative to the wrapping paper roll-receiving pockets, the securing band forming a loop aligned with a respective cylindrical pocket of the plurality of wrapping paper roll-receiving pockets to help secure a wrapping paper roll disposed in one of the wrapping paper roll-receiving pockets; and a flexible second supply holding portion secured onto the second substantially planar side of the frame, the second supply holding portion including second supply receiving features thereon, the first and second supply holding portions each having an inwardly facing surface facing the opposing supply holding portion and an outwardly facing surface facing away from the opposing supply holding portion, the first and second supply receiving features being disposed on the outwardly facing surface of the respective first and second supply holding portions.

24. The system of claim 19, wherein each of the first and second supply holding portions is a sleeve that receives one of the first and second substantially planar sides of the frame portion.

25. The system of claim 23, comprising a wrapping paper dispenser comprising a plurality of C-shaped dispenser portions pivotable about an axis between a workstation orientation and a storage orientation.

26. A method of using a gift wrapping supply organization system having at least two outwardly facing sides, comprising:

inserting at least one roll of gift wrapping paper into a longitudinally extending wrapping paper roll-receiving pocket on one of the outwardly facing sides of the organization system, the wrapping paper roll-receiving pocket being relatively cylindrically-shaped, having a pocket opening, and being sized to receive at least a portion of a cylindrical wrapping paper roll, the step of inserting at least one roll of gift wrapping paper comprising securing the at least one roll of gift wrapping paper to the system using a securing band disposed above the pocket opening of the wrapping paper roll-receiving pocket, the securing band forming a loop aligned with the wrapping paper roll-receiving pocket to help secure the at least one roll of wrapping paper roll disposed in the wrapping paper roll-receiving pocket;

inserting at least one other gift wrapping supply into a supply feature on one of the outwardly facing sides of the orientation system;

expanding the system from a storage orientation where the outwardly facing sides are substantially parallel to a workstation orientation where the system is free-standing;

removing, using, and replacing at least a portion of the at least one roll of gift wrapping paper;

collapsing the system from the free-standing workstation orientation to the substantially parallel storage orientation; and hanging the system for storage using a hanger hook.

27. The method of claim 21, wherein expanding the system comprises:

pivoting one of the outwardly facing sides relative to the other outwardly facing sides to form an angle between the two sides; and limiting the degree of pivoting with a connection mechanism.

28. A storage and organization system for supplies, comprising:

a collapsible A-frame portion providing structural support to the system, the frame portion having first and second substantially planar sides pivotable about an apex in a range of about 60 degrees or less between a first workstation orientation and a second storage orientation, the first workstation orientation being a orientation where the first and second sides form an angle and the second storage orientation being a orientation where the first and second sides are substantially parallel, each of the first and second substantially planar sides having an inwardly facing surface facing the opposing substantially planar side and an outwardly facing surface facing away from the opposing substantially planar side, first supply holding portions disposed on the outwardly facing surface of the first substantially planar side of the frame portion, the first supply holding portions comprising a plurality of longitudinally extending wrapping paper roll-receiving pockets, each of the wrapping paper roll-receiving pockets having an upper pocket opening and a pocket bottom, the wrapping paper roll-receiving pockets being relatively cylindrically-shaped and sized to receive at least a portion of a cylindrical wrapping paper roll; and a securing band disposed above at least one pocket opening of the plurality of longitudinally extending wrapping paper roll-receiving pockets and extending in a lateral direction relative to the wrapping paper roll-receiving pockets, the securing band forming a loop aligned with a respective cylindrical pocket of the plurality of wrapping paper roll-receiving pockets to help secure a wrapping paper roll disposed in one of the wrapping paper roll-receiving pockets; and second supply holding portions disposed on the outwardly facing surface of the second substantially planar side of the frame portion such that supplies may be disposed on the outwardly facing surfaces of both the first and second substantially planar sides of the A-frame portion.

29. The system of claim 1, comprising a supply dispenser disposed on one of the first and second supply holding sides, the supply dispenser comprising a supply arm selectively removable relative to the first and second supply holding sides, the supply dispenser having at least one supporting structure for supporting the rod in a manner that a roll of supplies may be disposed on the rod for access by a user.

30. The system of claim 1, wherein the cylindrically shaped pockets comprise D-shaped pockets.

31. The system of claim 1, wherein the securing band forms a loop having a diameter size similar to the diameter size of the wrapping paper roll-receiving pocket.

* * * * *